United States Patent [19]

Odani et al.

[11] Patent Number: 4,818,308

[45] Date of Patent: Apr. 4, 1989

[54] ALUMINUM ALLOY AND METHOD FOR PRODUCING THE SAME

[75] Inventors: Yusuke Odani; Kiyoaki Akechi; Nobuhito Kuroishi, all of Itami, Japan

[73] Assignee: Sumitomo Electric Industries, Inc., Osaka, Japan

[21] Appl. No.: 940,168

[22] Filed: Dec. 10, 1986

Related U.S. Application Data

[63] Continuation of Ser. No. 677,472, Dec. 3, 1984, abandoned.

[30] Foreign Application Priority Data

| | | | |
|---|---|---|---|
| Dec. 2, 1983 | [JP] | Japan | 58-228968 |
| Dec. 9, 1983 | [JP] | Japan | 58-233245 |
| Jan. 7, 1984 | [JP] | Japan | 59-1090 |
| Mar. 23, 1984 | [JP] | Japan | 59-56492 |

[51] Int. Cl.[4] ..... C22C 21/00

[52] U.S. Cl. ..... 148/437; 148/438; 148/439; 148/440; 75/249

[58] Field of Search ..... 420/547, 548, 534, 537, 420/546; 419/66–69; 75/249; 148/11.5 P, 437–440, 11.5 A

[56] References Cited

U.S. PATENT DOCUMENTS

| | | | |
|---|---|---|---|
| 3,325,279 | 6/1967 | Lawrence et al. | 420/547 |
| 4,435,213 | 3/1984 | Hildeman et al. | 148/11.5 P |

*Primary Examiner*—R. Dean

*Attorney, Agent, or Firm*—Cushman, Darby & Cushman

[57] ABSTRACT

Aluminum alloy comprises 10 to 36 wt % of Si, 2 to 10 wt % of at least one metal selected from the group consisting of Fe, Ni, Co, Cr and Mn, and remainder consisting essentially of aluminum. The aluminum alloy further includes 1.0 to 12 wt % of Cu and 0.1 to 3.0 wt % of Mg. In a method for producing the aluminum alloy the steps comprises preparing powder mixtures including Si, at least one of metal selected from the group consisting of Fe, Ni, Co, Cr and Mn, and remainder consisting essentially of Al, producing aluminum alloy powders, compacting the aluminum alloy powders into a shape and hot working the aluminum alloy powder compact.

6 Claims, 3 Drawing Sheets

ALUMINUM ALLOY AND METHOD FOR PRODUCING THE SAME

This is a continuation of application Ser. No. 677,472, filed Dec. 3, 1984, which was abandoned upon the filing hereof.

BACKGROUND OF THE INVENTION

The present invention relates to improvements in aluminum alloys which are light weight and of high strength. More particularly, it is concerned with an aluminum alloy which possesses, the above characteristics of light weight and high strength, as well as high heat resistance, high wear resistance and low expansion coefficient, and a process for the production of the aluminum alloy.

The present invention further relates to an improvement in the characteristics, particularly modulus of elasticity of an aluminum alloy, and method for producing the same.

Aluminum alloys are light weight and have about one third the specific gravity of steel materials, and also superior in corrosion resistance. Furthermore, since plastic working can be carried out easily at low temperatures, they are metallic materials suitable for a reduction in weight of equipment and energy-saving. However, aluminum itself is inherently low in strength and inferior in heat resistance and wear resistance. It is therefore unsuitable for use in fabrication of mechanical parts for which are required a high strength, and heat resistance and wear resistance.

Recently, various alloying methods and heat treatments, for example, have been developed. As a result, high performance aluminum materials have been developed and its application in various fields is now under investigation. For example, in 1911, A. Wilm developed high strength aluminum alloys such as Duralumin, and these aluminum alloys have been widely used in production of air crafts. Duralumin has a composition of 4% Cu, 0.5% Mg, 0.5% Mn, 0.3% Si, with the balance being Al, and has a tensile strength of about 40 kg/mm$^2$ (see Hashiguchi ed., *Kinzoku Gaku Handbook* (*Handbook of Metallography*), 1958). In addition, as heat resistant and wear resistant materials, aluminum/siliconbase alloys have been developed. They are called "Silmin" TM, in which wear resistance is increased by adding from 10 to 20% by weight of Si particles to the Al matrix. In this case, however, the primary silicon crystals are readily increased in size as the result of addition of a large amount of Si, and the strength is inevitably decreased.

As heat resistant, wear resistant materials, Al-Fe-base and Al-Si-base alloys, for example, are known. At present, an extensive investigation is being made on their application as engine parts of a vehicle, such as a piston, and a cylinder liner. For these heat resistant, wear resistant alloys, it is also required that the coefficient of thermal expansion is low. An aluminum alloy usually has a coefficient of thermal expansion of more than $22\times10^{-6}$/°C. In production of a piston, for example, it is desirable that the aluminum alloy have a coefficient of thermal expansion of not more than $21\times10^{-6}$/°C. For many of the conventional Al-Fe-base and Al-Si-base alloys, the coefficient of thermal expansion is more than $21\times10^{-6}$/°C. Thus they are not suitable for use in the production of a piston, for example.

As alloys produced by powder metallurgy, aluminum sintered bodies in which finely divided aluminum oxide is dispersed in aluminum have been developed under the name of "SAP". They were developed to increase heat resistance, and their strength is 35 kg/mm$^2$ and thus they are brittle, i.e., they have a disadvantage in that the impact resistance is low. For this reason, they have not yet been put into practical use.

Production of mechanical parts of aluminum alloys by the powder metallurgical method has now been put into practical use. In addition to a method comprising the usual powder compacting the sintering and sizing, a cold forging method in which after sintering, coining is applied is also included. Aluminum alloy mechanical parts produced by the above powder metallurgical method, however, are inferior in mechanical properties such as tensile strength, wear resistance, and heat resistant strength to those produced by cutting, forging, and casting of melted materials.

Next, explanation is made as to an improvement of modulus of elasticity in high strength aluminum alloy.

As high strength aluminum alloy materials, a 7000 alluminum alloy and a 2000 aluminum alloy are well known. In recent years, a 7090 aluminum alloy and a 7091 aluminum alloy having a much higher strength have been developed in U.S.A.

Such high strength aluminum alloys are used mainly in the production of air crafts. For these aluminum alloys for air crafts are required to have high elasticity and high strength. It is desirable that the modulus of elasticity and strength be at least 8,500 kg/mm$^2$ and at least 60 kg/mm$^2$, respectively. Aluminum alloys now on the market have a tensile strength of about 60 kg/mm$^2$, but their modulus of elasticity is less than 8,000 kg/mm$^2$, which is less than ½ of that of the iron-base material. Furthermore, it is said that these aluminum alloys are sacrificed in corrosion resistance. in order to produce an aluminum alloy having a high modulus of elasticity, attempts to combine with carbon or ceramic fibers, or particles, or to add lithium, for example, have been made. No satisfactory aluminum alloy has been developed.

For many of mechanical parts which need high wear resistance, high strength and high heat resistance are required at the same time. Thus the above-described conventional aluminum alloys are not suitable for use in the production of such mechanical parts.

SUMMARY OF THE INVENTION

The present invention is intended to overcome the above problems, and an object of the present invention is to provide a high heat resistant, wear resistant aluminum alloy that is provided with high strength, high wear resistance, and high heat resistance as well as improved coefficient of expansion, which are required for mechanical parts, by adding alloying elements superior to improving wear resistance and alloying elements superior in improving heat resistance in a suitable ratio to aluminum alloys.

Another object of the present invention is to provide such a aluminum alloy and to provide a process for the production of the aluminum alloy, in which the wear resistance and heat resistance and also the thermal expansion of the aluminum alloy are greatly improved by adding a silicon element for improving wear resistance and at least one metal element selected from the group consisting of Fe, Ni, Co, Cr and Mn for improving heat resistance and mechanical strength at room temperature in a suitable ratio to aluminum.

The present invention is further intended to improve the characteristics of an aluminum alloy, and it has been found in the course of improving the strength, wear resistance, and heat resistance by adding a silicon element, an iron element, a copper element, and a magnesium element to the aluminum that an aluminum alloy containing a silicon element in a concentration in the vicinity of the eutectic point has a high modulus of elasticity.

According to one embodiment of the invention, aluminum alloy comprises 10 to 36 wt % of Si, 2 to 10 wt % of at least one of metal selected from the group consisting of Fe, Ni, Co, Cr and Mn, and remainder consisting essentially of aluminum. The aluminum alloy of the present invention further includes 1.0 to 12 wt % of Cu and 0.1 to 3.0 wt % of Mg.

According to a method for producing the aluminum alloy comprises the steps of: preparing powder mixtures including 10 to 36 wt % of Si, 2 to 10 wt % of at least one of metal selected from the group consisting of Fe, Ni, Co, Cr and Mn, and remainder consisting essentially of Al; producing aluminum alloy powders; compacting the aluminum alloy powder into a shape; and hot working the aluminum alloy powder compact. The hot working may be extrusion or forging the aluminum alloy powder preform.

According to another embodiment of the invention, aluminum alloy comprises 7.0 to 17.0 wt % of Si, not more than 12 qt % of Fe, not more than 2 wt % of Mg, not more than 6.5 wt % of Cu, and remainder Al. The aluminum alloy has modulus of elasticity not less than 8000 kg/mm$^2$. A method for producing aluminum alloy comprises the steps of: preparing powder mixture including 7.0 to 17.0 wt % of Si, not more than 12 wt % of Fe, not more than 2 wt % of Mg, not more than 6.5 wt % of Cu, and remainder Al; producing aluminum alloy powders; and hot working the aluminum alloy powders.

DESCRIPTION OF THE PREFERRED EMBODIMENTS

Figure 1:
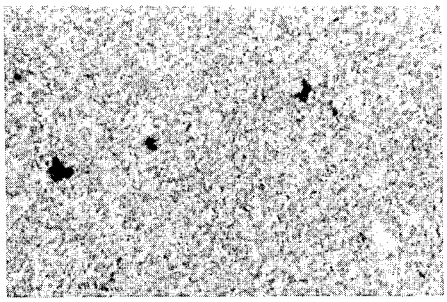
FIG. 1 is a micrograph (1000) of an aluminum alloy produced in Example of the present invention.

In the aluminum alloy of the present invention, a silicon element is added to increase the wear resistance. The amount of the silicon element added is from 10 to 36% by weight and preferably 10 to 20% by weight. If the amount of the silicon element added is not more than 10% by weight, the wear resistance is improved only insufficiently. As the amount of the silicon element added is increased, the wear resistance is more increased. Addition of an excess amount of the silicon element, however, leads to a reduction in the strength of the ultimate aluminum alloy. Thus the silicon element is added in an amount not more than 36% by weight. In the usual wear resistant Al-Si-base alloy, the silicon element can be incorporated in an amount up to about 50% by weight by the powder metallurgical method, and the silicon content is changed depending on the purpose for which the ultimate aluminum alloy is used. As a result of extensive investigations, it has been found that if the silicon and at least one metal element selected from Fe, Ni, Co, Cr and Mn are added in a suitable ratio, there can be obtained an aluminum alloy exhibiting wear resistance higher than that of a high silicon-content wear resistant Al-Si-base alloy and, furthermore, having a greatly low coefficient of thermal expansion without the addition of a large amount of the silicon element. This aluminum alloy exhibits higher heat resistance even when at least one metal element is added in an amount less than that in the usual Al-Fe-base heat resistant alloy. The amount of the metal element added is appropriately between 2 and 10% by weight. Outside this range, the heat resistance, wear resistance, and coefficient of thermal expansion are improved only insufficiently. If the amount of the iron element added is too large, the ultimate aluminum alloy has a disadvantage in that workability such as hot extrusion is poor.

If at least one metal and silicon elements are added in a suitable ratio, strength, the heat resistance, wear resistance, and coefficient of thermal expansion are improved greatly at the same time. In view of this marked reduction in coefficient of thermal expansion, the aluminum alloy of the present invention can be expected to find many uses.

The aluminum alloy powder that is used in the present invention is basically an Al-Si-Fe-base alloy and, for the purpose of further increasing the strength of the alloy, copper and magnesium elements are added thereto. The copper element is added to increase the strength to enhance precipitation in the matrix. Even if the copper element is added in amounts more than 12% by weight, no marked increase in strength can be obtained, and moreover the density is increased. Thus it is not necessary to add the copper element in amounts more than 12% by weight. However, since the copper contributes to heat resistance, it is preferred to add in a certain amount in a range of 1.0 to 12 wt %. Addition of the magnesium element also contributes to an increase in the strength. However, if the magnesium element is added in large amounts, workability is reduced. Thus the amount of the magnesium element is in a range of 0.1 to 3.0 wt %.

The aluminum alloy of the present invention is difficult to produce by the conventional casting method, because the amounts of silicon and at least one metal element such as Fe are large. The reason for this is that the primary crystals of silicon and iron are coarsened at the time of solidification. These strong coarse primary crystalline particles seriously deteriorate the strength. In order to decrease the size of the coarse primary crystals, it is important that a rate of solidification of the alloy be increased. This is difficult to attain by the casting method. Thus, for this purpose, the powder metallurgical method is employed. That is, rapidly solidified aluminum alloy powder is first produced, and then the desired alloy is produced using the alloy powder in which the primary crystals are reduced in size.

In order to prevent the formation of coarse primary silicon crystals, when the alloy powder is used in the form of a gas atomized powder, it is preferred that its grain size be −40 mesh. In the case of the gas atomized powder, as long as the grain size is −40 mesh, the grain diameter of the primary crystals can be controlled to 10 μm or less. The grain diameter of the primary crystals is sometimes increased by a variation in production conditions. In this case, it is necessary to use a powder in which the grain diameter of the primary crystals is 10 μm or less.

According to one embodiment of the present invention, above-prepared aluminum alloy powders are packed directly in a can or compacted. This can or mold is then heated to 250°–550° C. and hot extruded at an extrusion ratio not less than 4:1, preferably not less than 10:1. In order to produce vanes for compressor, the ratio be not less than 20:1. If the temperature is less than 250° C., plugging occurs. On the other hand, if it is more than 550° C., the primary silicon crystals are coarsened during working, and an extruded material having good characteristics cannot be obtained. If the extrusion ratio is less than 4:1, a material having a sufficiently high strength cannot be obtained. Thus, the extrusion is carried out within the above-defined ratio.

The thus-extended material is subjected to a suitable heat treatment and then machined into the desired product.

EXAMPLE 1

An aluminum alloy powder containing 12% by weight of silicon and 8% by weight of iron, of −100 mesh which had been gas atomized was packed in a sheath made of copper or aluminum and sealed, which was then heated to 450° C. and hot extrusion at an extrusion ratio of 6.5:1.

The characteristics of the hot extruded material under the above conditions were evaluated, and the results are shown in Tables 1 and 2. As can be seen from its micrograph (1000) shown in FIG. 1, the structure of the aluminum alloy was fine and uniform.

1. Tensile Strength at High Temperatures (determined after holding for 20 minutes at each temperature)

TABLE 1

| Temperature (°C.) | Tensile Strength (kg/mm²) |
|---|---|
| R.T. | 42 |
| 100 | 44 |
| 200 | 40 |
| 300 | 28 |
| 400 | 12 |

2. Ring Crash Strength at High Temperature

TABLE 2

| Temperature (°C.) | Ring Crash Strength at High Temperature (kg/mm²) |
|---|---|
| R.T. | 65 |
| 100 | 86 |
| 200 | 85 |
| 300 | 63 |
| 400 | 32 |
| 500 | 16 |

3. Wear Test (by the Ogoshi method)
Pressure: 3.3 kg
Wear Distance: 200 m

| | | | |
|---|---|---|---|
| Sliding Speed (m/s): | 0.5 | 2.0 | 3.6 |
| Specific Wear Amount: (mm²/kg) × $10^{-7}$ | 2.1 | 1.8 | 7.1 |

4. Coefficient of Thermal Expansion
$17.5\times10^{-6}$/°C. at 300° C.

The Al-Si-Fe-base alloy produced by the process of the present invention in which silicon and iron are added in a suitable ratio is superior in heat resistance and wear resistance and further has a very low coefficient of thermal expansion. Thus the alloy is excellent as a heat resistant material.

EXAMPLE 2

An alloy powder of 4% Cu, 1% Mg, 12% Si, 5% Fe, the balance being Al, having a grain size of −40 mesh which had been produced by atomizing method was placed in a sheath made of copper and then sealed, which was then heated to 450° C. and extruded at an extrusion ratio of 10:1. The thus-produced alloy was examined.

Figure 2:
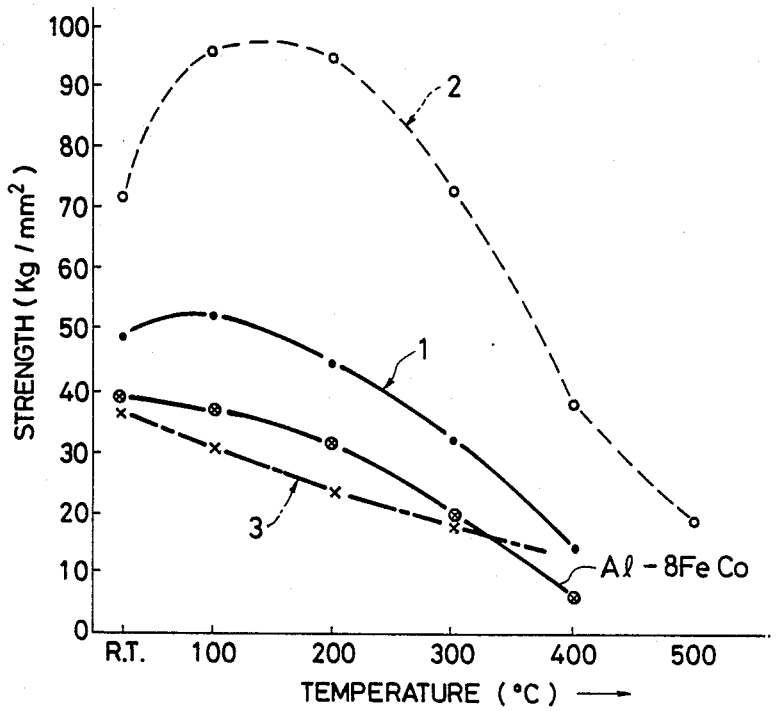
FIG. 2 is a graph showing the relation between temperature and the tensile strength (1) or ring crash resistance (2) of the alloy of the present invention, or the tensile strength of the conventional sintered Al alloy (3)

FIG. 2 shows the results of the measurement of strength of a test piece which had been cut off of the above alloy material. The tensile strength 1 and 2 of the alloy of the present invention are high at room temperature and also at high temperatures, and are superior compared with the tensile strength 3 of the conventional heat resistant Alsintered body (SA).

The wear resistance as determined by the Ogoshi wear testing method is shown in Table 3.

TABLE 3

| | Specific Wear Amount (mm/kg) × $10^{-7}$ Sliding Speed (m/s) | | |
|---|---|---|---|
| Test Piece | 0.5 | 2.0 | 3.6 |
| Alloy of the Invention | 1.6 | 1.2 | 6.2 |
| Comparative Alloy 1 | 3 0 | 12.3 | 11.4 |
| Comparative Alloy 2 | 3.1 | 19.8 | 13.0 |

In Table 3 above, the comparative alloy 1 is an AC-8A-T6 cost Al-Si alloy processed material conventionally used in the production of pistons, and the comparative alloy 2 is a material 7090 produced by the powder metallurgical method.

A coefficient of thermal expansion of the alloy of the present invention is $16.1\times10^{-6}$/°C. between ordinary temperature and 300° C., which is greatly small compared with $24.0\times10^{-6}$/°C. of pure aluminum. Thus the alloy of the present invention can be advantageous as a heat resistant material. As mentioned above, an alloying element can be added in a supersaturated condition by the rapidly solidifying method and, as a result of rapid-cooling, crystal grains are finely dispersed, segregation is avoided, a uniform structure can be obtained and, furthermore, a melted material from which the present powder metallurgical material is made can be obtained, which is much superior in performance to the conventional ingot metallurgical materials. These rapidly solidified alloys, however, can be produced only by the extrusion method, for example, and thus problems are encountered in producing mechanical parts. The reason for this is that an aluminum alloy usually has a stable oxide $Al_2O_3$ on the surface thereof and, therefore, it is very difficult to sinter the aluminum alloy in the solid state and mechanical parts cannot be almost produced using the aluminum alloy. A method has been proposed in which alloying elements such as copper, magnesium, and silicon, capable of forming eutectics with aluminum are added to form a liquid phase, and the $Al_2O_3$ film is broken by the liquid phase. In the case of rapidly solidifying alloy powder, however, this method cannot be employed since coarse precipitates are formed and segregation is caused.

According to a second embodiment of the invention, instead of the extrusion method, forging is applied. First, aluminum alloy powders produced by the method described above is used. In producing a preform of such strength that no cracks are formed during forging, it is essential that the density be increased to a sufficiently high level and then sintering be applied. The density can be increased satisfactorily by increasing the compacting pressure. In compacting of particles of high hardness, the cold-isostatic pressing method is more effective than the ordinary pressing using a metal die. This high density compacting breaks the oxide coating on the powdered particles, thereby greatly increasing the contact area of the particles. Thus, as the sintering proceeds through solid diffusion during heating, a good sintered body for forging can be obtained.

At the step of forging, residual voids are collapsed, and sintering due to pressure proceeds on the oxide coating-free clean surface.

For the above purpose, hot forging should be employed in place of cold forging. One of the reasons for this is that the sintering is allowed to proceed sufficiently. Another reason is that a deformation resistance in forging is reduced and the deformation into complicated shapes can be attained. If the density after compacting is less than 95%, the voids are connected to the interior and thus air is allowed to pass therethrough. As a result, oxidation readily proceeds. For this reason, it is necessary that the true density ratio be at least 95%.

Heating temperatures lower than 250° C. are not suitable, since at such low temperatures the deformation resistance is large and the sintering due to self diffusion of aluminum does not proceed sufficiently. On the other hand, higher temperatures than 550° C. are not suitable since at such high temperatures the fine structure and nonequilibrium phase of the solidified powder by rapid cooling are changed and the features of the rapidly cooled alloy are lost.

EXAMPLE 3

An alloy powder containing 4% Cu, 1% Mg, 12% Si, 5% Fe, the remainder being Al, and having a grain size of −100 mesh which had been obtained by gas atomizing was compacted at a pressure of 6 t/cm$^2$ by the use of a coldisostatic press. The density of the compact was 2.67 g/cm$^3$, and its actual density ratio was 96.0%. The thus-obtained high density compact was heated to 470° C. in the air to conduct die forging. The height of the die was decreased to about ½ by the forging and extended along the die in the direction of diameter. The density of the forged product was 99.8% or more, and no cracking occurred. A test specimen was cut off from this forged body, and tested.

Figure 3:
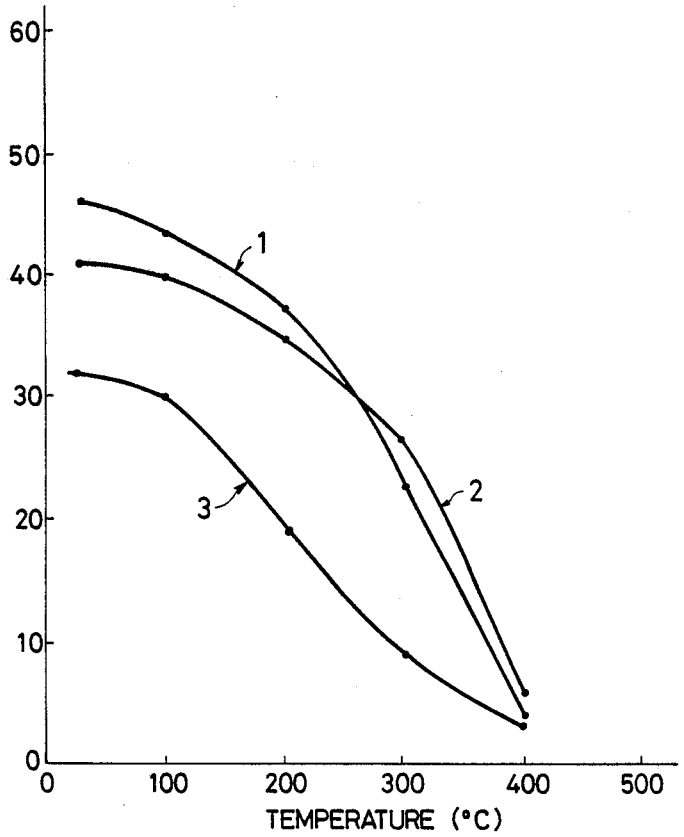
FIG. 3 is a graph showing the variations (1), (2) in tensile strength at high temperatures of the materials of the present invention and the comparative material (3).

FIG. 3 shows the results of measurement of the strength. The Al-Cu-Mg-Si-Fe-base material 1 and the Al-Si-Fe-base material 2 of the present invention were of high strength at high temperatures. With regard to the tensile strength, the material 1 is higher than the material 2 up to about 200° C. but at higher temperatures the material 2 is higher than the material 1. Both the materials 1 and 2 are higher in strength than th AC8A-T6 material 3 (cast Al-Si alloy) which has been used as a material for production of a piston.

The wear resistance as determined by the Ogoshi wear testing method is shown in Table 4. The materials of the present invention is superior in wear resistance to the comparative AC8A-T6 material.

The results of the measurement of coefficient of thermal expansion are shown in Table 5. The coefficient of thermal expansion of the materials of the present invention are markedly small compared with that of the comparative AC8C-T6 materials, and thus they are useful as a heat resistant material.

TABLE 4

| Test Piece | Specific Wear Amount ($\times 10^{-7}$ mm$^2$/kg) Sliding Speed (m/s) | | |
|---|---|---|---|
| | 0.5 | 2.0 | 3.6 |
| Material 1 of the Invention | 1.9 | 1.8 | 5.6 |
| Material 2 of the Invention | 2.8 | 3.8 | 6.2 |
| Comparative material 3 | 3.0 | 12.1 | 9.2 |

TABLE 5

| Test Piece | Coefficient of Thermal Expansion ($\times 10^{-6}$/°C.) |
|---|---|
| Material 1 of the invention | 16.3 |
| Material 2 of the invention | 16.7 |
| Comparative Material 3 | 21.6 |

It can be seen from the above results that aluminum alloys which are light weight and have superior characteristics can be produced by the powder forging method and, in turn, mechanical parts of such aluminum alloys can be produced economically.

Turning next, improvement of modulus of elasticity in aluminum alloy will be described with reference to a third embodiment of the present invention.

In the aluminum alloy according to the third embodiment of the present invention, the silicon element is important. The concentration of the silicon element is from 7.0 to 17.0% by weight.

In the phase diagram of an Al-Si-base alloy, the eutectic point exists at 11.7% Si. In the aluminum alloy of the third embodiment, the Si concentration is in the range of the eutectic point ±5%. In the aluminum alloy of this embodiment, the amount of the silicon is 15% or 7%, the modulus of elasticity tends to drop compared with 12Si. Thus, in order to obtain a high modulus of elasticity, it is desirable that the concentration of the silicon element approaches to the vicinity of the eutectic temperature.

As the amount of the iron element added is increased, the resulting aluminum alloy tends to have a higher modulus of elasticity. If the amount of the iron element added is in excess of 12% by weight, hot plastic workability (hot forgeability, hot rolling properties, and hot extrudability) is seriously deteriorated. Thus the amount of the iron element added is adjusted to not more than 12% by weight.

Magnesium and copper elements are added to enhance the precipitation of the matrix. The amounts of the magnesium and copper elements added are not more than 2% by weight and not more than 6.5% by weight, respectively.

If the amount of the magnesium element added is large, workability is deteriorated. Thus the amount of the magnesium element added is not more than 2% by weight. Even if the amount of the copper element added is increased, any marked increase in strength cannot be obtained; rather the formation of fine pores is caused. Thus it is preferred that the amount of the copper element added be not more than 6.5% by weight.

The aluminum alloy of the present invention, which contains such large amounts of silicon and iron elements, is difficult to produce by the conventional casting method. The reason for this is that if the silicon and iron elements are added to the aluminum matrix in large amounts, primary crystals resulting from coarse silicon and iron grains are formed, since the degrees of solid solution of silicon and iron in the aluminum are small; this leads to a marked reduction in the strength of the ultimate alloy.

Techniques to produce finely dispersed primary crystals of silicon and iron include a method of adding small amounts of phosphorus, for example. Particularly effective is to increase a rate of solidification at the solidification of a melt. For this purpose, an aluminum alloy melt is powdered by atomizing in the air or atmosphere gas by the use of water or gas, or by a mechanical procedure to produce a powder of −40 mesh, or solidification is allowed to proceed at a rate of solidification of at least $10^2$ K/s (100K cooling per second). In the case of −40 mesh atomized powder, the rate of solidification is $10^2$ K/s or more. In the case of the alloy solidified at a rate of $10^2$ K/s or more, precipitates of 10 μm or more are not formed and thus a fine uniform structure is obtained. When the thus-produced powder is subjected to hot plastic working (hot extrusion and hot forging), there can be obtained an alloy material having a uniform and fine structure in which the true specific density ratio is almost 100%.

The thus-produced aluminum alloy material is very improved in all the strength, heat resistance, and wear resistance compared with the conventional aluminum alloys.

EXAMPLE 4

A −100 mesh Al-Si-Fe-Cu-Mg-base alloy powder which had been produced by air atomizing was hot extruded to produce a hot extruded material. The characteristics of this material were examined.

In this extrusion, the alloy powder was packed in a can, heated at 470° C. for about 2 hours, and then extruded at an extrusion ratio of about 7:1.

The characteristics of the above-produced Al-Si-FeCu-Mg-base alloy material are shown in Table 6. For comparison, the characteristics of 2014 and 7075 strong aluminum alloy materials produced by the casting method are also shown in Table 6.

The modulus of elasticity was measured by the gauge method and by the supersonic method. The results obtained by these methods were in good agreement with each other.

TABLE 6

| Material | Modulus of Elasticity (kg/mm²) | Tensile Strength (kg/mm²) | Hardness HRB |
|---|---|---|---|
| Al—7Si—5Fe | 7730 | 39 | 61 |
| Al—12Si—3Fe | 9360 | 44 | 65 |
| Al—12Si—5Fe | 9880 | 49 | 69 |
| Al—12Si—7Fe | 10480 | 54 | 75 |
| Al—15Si—2Fe | 7410 | 48 | 76 |
| Al—15Si—4Fe | 7790 | 54 | 85 |
| Al—15Si—6Fe | 8190 | 58 | 92 |
| Al—15Si—8Fe | 8680 | 59 | 93 |
| 2014-T4 | 7500 | 49 | 73 |
| 7075-T6 | 7300 | 58 | 85 |

The Al-Si-Fe-base alloys contained 4.5% by weight of copper and 1% by weight of magnesium.

It can be seen from Table 6 that in the aluminum alloys containing 12% by weight of silicon in the vicinity of the eutectic concentration, the modulus of elasticity is high compared with the aluminum alloys containing 7% by weight and 15% by weight of silicon which are apart from the eutectic concentration.

In addition, the aluminum alloys have high tensile strength and hardness, are good in wear resistance and heat resistance, have a small coefficient of thermal expansion, and are good in plastic workability.

As demonstrated above, an Al-Si-Fe-Cu-Mg-base alloy containing a eutectic concentration of a silicon element is good all the mechanical and thermal properties, and plastic workability.

In view of the above, the alloy of the present invention is widely applicable for producing mechanical parts for air craft, automobile such as engine, piston, cylinder liner and connecting rod, electrical appliance and parts for precise mechanism.

What is claimed is:

1. An aluminum alloy consisting of:
10–36 wt. % of silicon;
2–12 wt. % of iron;
2–10 wt. % of metal selected from the group consisting of nickel, cobolt, chromium, manganese, mixtures thereof;
1 to not more than 6.5 wt. % of copper;
0.1 to not more than 2 wt. % of magnesium; and
the remainder of said alloy consisting of aluminum, said aluminum alloy having a modulus of elasticity not less than 8,000 kg/mm²;
wherein said aluminum alloy said silicon comprises primary silicon crystals having a size of 10 μm or less in diameter and said alloy has a tensile strength of at least above 40 kg/mm².

2. An aluminum alloy consisting of:
10–36 wt. % of silicon;
2–10 wt. % of nickel;
2–10 wt. % of at least one metal selected from the group consisting of iron, cobolt, chromium, manganese;
0 to 6.5 wt. % of copper;
0 to 2 wt. % of magnesium; and
the remainder of said alloy consisting of aluminum;
wherein in said aluminum alloy said silicon comprises primary silicon crystals having a diameter of 10 μm or less and said alloy has a tensile strength of at least above 40 kg/mm².

3. An aluminum alloy according to claim 2 wherein said alloy contains:
1 to not more than 6.5 wt. % of copper; and
0.1 to not more than 2 wt. % of magnesium.

4. An aluminum alloy according to claim 1, wherein said alloy contains 10 to 20 wt. % of silicon.

5. An aluminum alloy consisting essentially of:
10–36 wt. % of silicon;
2–10 wt. % of iron;
0 to 6.5 wt. % of copper;
0 to 2 wt. % of magnesium; and
the remainder of said alloy consisting of aluminum,
wherein said aluminum alloy said silicon comprises primary silicon crystals having a diameter of 10 μm or less and said alloy has a tensile strength of at least above 40 kg/mm².

6. An aluminum alloy consisting essentially of:
10–36 wt. % of silicon;

2–10 wt. % of nickel;
0 to 6.5 wt. % of copper;
0 to 2 wt. % of magnesium; and
the remainder of said alloy consisting of aluminum
wherein said aluminum alloy said silicon comprises primary silicon crystals having a diameter of 10 μm or less and said alloy has a tensile strength of at least above 40 kg/mm$^2$.

* * * * *